US006520615B1

(12) United States Patent
Beck et al.

(10) Patent No.: US 6,520,615 B1
(45) Date of Patent: Feb. 18, 2003

(54) THERMAL INKJET PRINT HEAD WITH INTEGRATED POWER SUPPLY FAULT PROTECTION CIRCUITRY FOR PROTECTION OF FIRING CIRCUITRY

(75) Inventors: Jeffery S. Beck, Corvallis, OR (US); Adam L Ghozeil, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/412,880

(22) Filed: Oct. 5, 1999

(51) Int. Cl.[7] ..... B41J 29/393
(52) U.S. Cl. ..... 347/19
(58) Field of Search ..... 347/19, 5, 58, 347/62, 78

(56) References Cited

U.S. PATENT DOCUMENTS 4,439,776 A * 3/1984 Zeiler et al. ..... 346/75
4,510,505 A * 4/1985 Fukui ..... 347/190
4,769,657 A * 9/1988 Takahashi ..... 347/171
4,774,526 A * 9/1988 Ito ..... 219/486
5,517,151 A * 5/1996 Kubota ..... 327/514
5,519,417 A * 5/1996 Stephany et al. ..... 347/14
5,642,148 A * 6/1997 Fukushima et al. ..... 347/211
5,736,997 A * 4/1998 Bolash et al. ..... 347/19
6,081,280 A * 6/2000 Bolash et al. ..... 347/5
6,183,056 B1 * 2/2001 Corrigan et al. ..... 347/14
6,435,668 B1 * 8/2002 Barbour et al. ..... 347/60

* cited by examiner

*Primary Examiner*—John S. Hilten
*Assistant Examiner*—K. Feggins

(57) ABSTRACT

A printer has a print head with multiple nozzles and firing elements for corresponding nozzles. The print head receives one or more power supply inputs to operate the firing elements. The print head has power supply fault protection circuitry to guard against harmful and destructive effects on firing resistors resulting from power supply fluctuations. The power supply fault protection circuitry is integrated into a pen-based chip that also forms the firing elements and optionally the firing logic.

18 Claims, 4 Drawing Sheets

THERMAL INKJET PRINT HEAD WITH INTEGRATED POWER SUPPLY FAULT PROTECTION CIRCUITRY FOR PROTECTION OF FIRING CIRCUITRY

TECHNICAL FIELD

This invention relates to inkjet printers, and more particularly, to techniques for protecting print head circuitry.

BACKGROUND

An ink-jet printer is a type of non-impact printer which forms characters and other images by controllably spraying drops of ink from a print head. One conventional type of ink-jet print head consists of a replaceable cartridge or pen which is removably mounted to a movable carriage. The pen controllably ejects liquid ink through multiple nozzles in the form of drops that travel across a small air gap and land on a recording media.

Ink droplets are ejected from individual nozzles by localized heating. A small heating element, typically in the form of a thermal resistor, is disposed at each nozzle. An electrical current is passed through the element to heat it up. The heated element vaporizes a tiny volume of ink, which is ejected through the nozzle. The heating elements are commonly formed on a single silicon wafer chip, which make the replaceable pen easy to assemble and inexpensive to produce.

Current print head technology also implements firing logic on the print head. The firing logic is formed into the silicon wafer that forms the nozzles and heated firing elements. This reduces the number of connections to the pen and allows the print head to decode data at least partially on the fly. Logic-based pens are relatively inexpensive to produce as the logic circuitry is incorporated into the same silicon chip that is used to hold the heating resistors.

A problem encountered in such print heads concerns destructive overheating of the firing resistors (or other circuit components) as a result of power supply surges or interruptions. It would be desirable to protect these circuit elements from interruptions to avoid the destructive overheating. Any solution, however, must be relatively inexpensive because the pens are designed to be replaceable and/or disposable to satisfy other manufacturing goals of providing an efficient way to replenish spent ink supplies.

Accordingly, there is a need for a replaceable inkjet print head that protects the logic circuitry (namely, the firing resistors) against power supply interruptions, without increasing the manufacturing cost of replaceable pens.

SUMMARY

This invention concerns an inkjet print head having power supply fault protection circuitry to guard against harmful and destructive effects on firing resistors resulting from power supply fluctuations. The power supply fault protection circuitry is integrated into a pen-based chip that also forms the firing elements and optionally the firing logic. As a result, the circuitry offers a low cost solution to problems associated with power supply fluctuations.

In a described implementation, the power supply fault protection circuitry has a power supply fault detector that detects if any one of a number of power sources are experiencing a fault condition (e.g., not present or not operating at proper levels). When a fault condition is detected, the fault detector outputs a "kill" signal. The protection circuitry also has a set of protection transistors, each coupled to the firing transistors of the inkjet print head. The "kill" signal turns on the protection transistors, which in turn turns off the firing transistors and overrides the firing signals. By halting firing, the protection circuitry protects the firing resistors from destructive overheating caused by fluctuations in the power sources.

DETAILED DESCRIPTION

Figure 1:
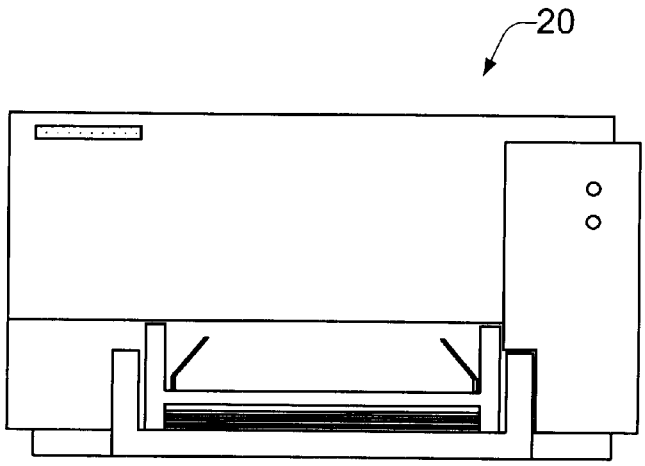
FIG. 1 is a diagram of an inkjet printer.

FIG. 1 shows a printer 20, embodied in the form of an inkjet printer. The printer 20 is representative of an inkjet printer series manufactured by HewlettPackard Company under the trademark "Deskjet". The inkjet printer 20 is capable of printing black-and-white and color. It is noted, however, that aspects of this invention may be implemented in other forms of printing devices that employ inkjet printing elements, such as facsimile machines, photocopiers, scanners, and the like.

Figure 2:
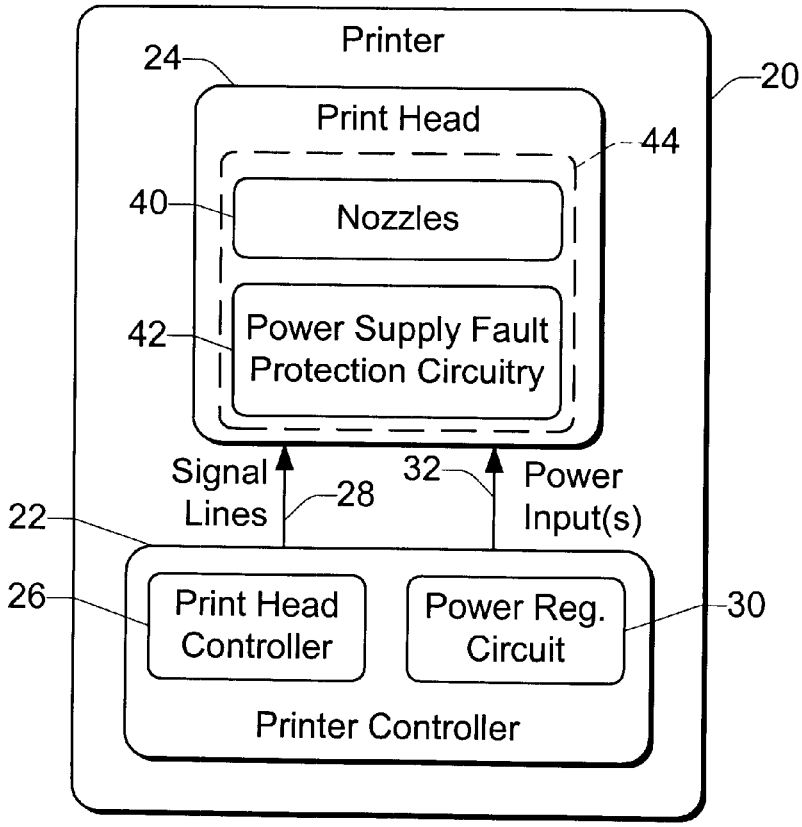
FIG. 2 is a block diagram of components in the printer.

FIG. 2 shows selected functional components of printer 20. These components include a printer controller 22 and a print head 24. Other components, such as the media handling mechanism, print head carriage, motor, power supply, host interface, and so forth, are not illustrated as they are well-known in the art.

The printer controller 22 has a print head controller 26 to process incoming file data received from the host and to convert the file data to print data. The print head controller 26 passes the print data onto the print head 24 over signal lines 28. The print head controller 26 may include a data encoder to encode the file data into firing bits that determine what nozzles are fired on the print head 24. A "firing" is the action of applying a firing pulse to an individual nozzle to cause that nozzle to deposit an ink drop.

The printer controller 22 also has a power regulation circuitry 30 that regulates power supplied from one or more supplies to one or more power signals used to operate circuitry on the print head 24. The power regulation circuitry 30 supplies the power signals to the print head 24 over power inputs 32. In addition to supplying power and data to the print head, the printer controller 22 also controls various other printer operations, such as media handling and carriage movement for linear positioning of the print head 24 over a recording media (e.g., paper, transparency, etc.).

The print head 24 has multiple nozzles 40 that are fired individually to deposit drops of ink onto the recording media according to the data from the printer control unit. As an example, the print head might have nozzles that number into the hundreds. The print head 24 also has power supply fault protection circuitry 42 to protect the nozzles 40 from excessive overheating that may result from power fluctuations in the power source signals 32. In one implementation, the power supply fault protection circuitry 42 is integrated with firing elements for the nozzles 40 in an integrated circuit (IC) chip 44 mounted on the print head 24. In this manner, the inkjet print head 24 may be implemented as a disposable, replaceable pen (or cartridge) with the protection circuitry integrated into the firing circuitry. The chip 44 may also incorporate firing logic (not shown) to selectively fire various nozzles 40. Alternatively, the firing logic resides entirely at the print head controller 26.

Figure 3:
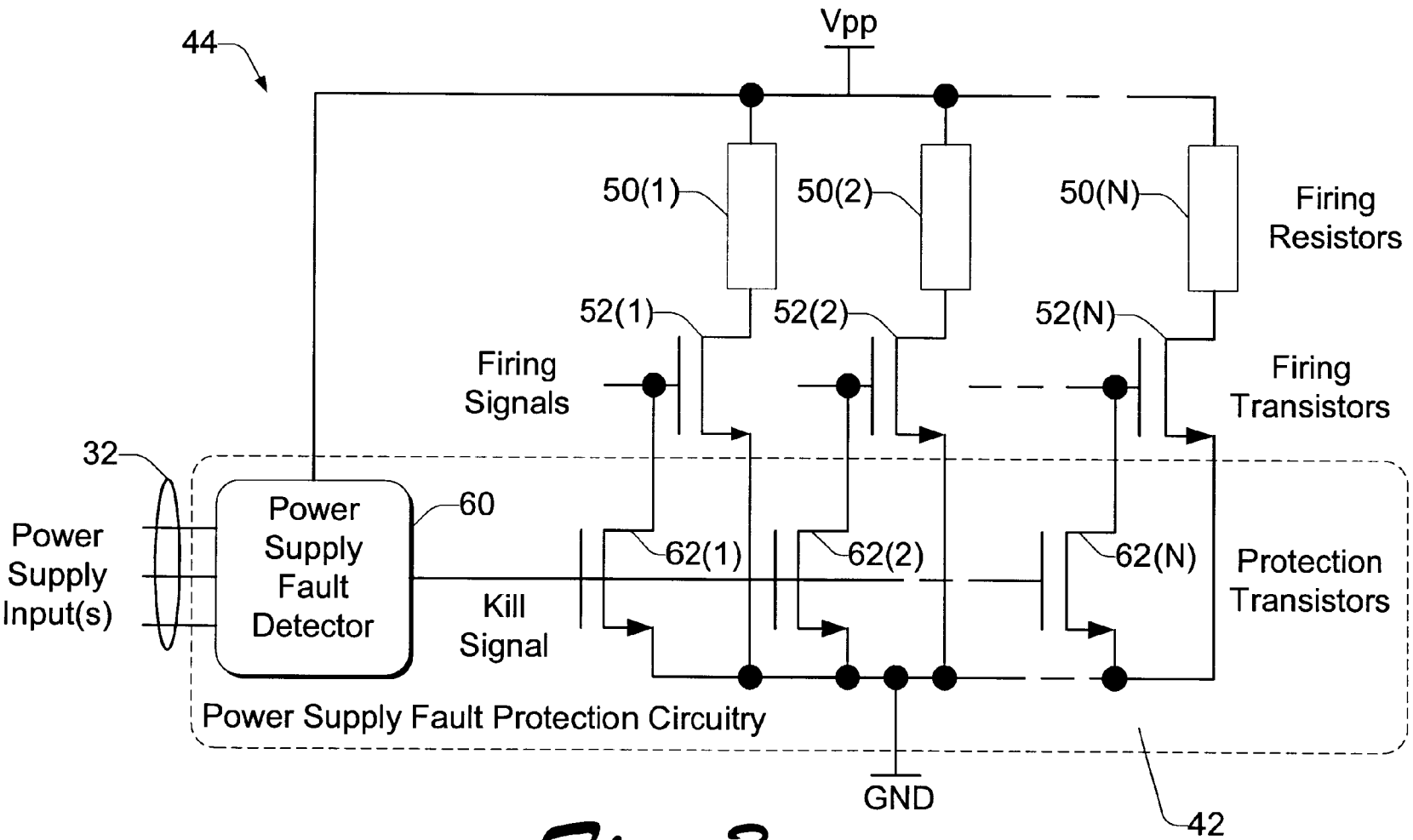
FIG. 3 is a schematic of pen-based logic in an inkjet print head, including a power supply fault protection circuitry.

FIG. 3 shows selected portions of the pen-based integrated circuit chip 44 implemented on the print head 24. The IC chip 44 has firing elements for each of the N nozzles on the print head. In this implementation, the firing elements include pairs of thermal resistors 50(1)–50(N) and firing transistors 52(1)–52(N) for each of the N nozzles. Each firing resistor 50 is coupled in series with the drain-to-source path of an associated transistor 52 between a power source Vpp and ground GND. When an associated firing transistor 52 is turned on by applying a firing signal at its gate, an electrical current is passed through the resistor 50 to heat it up. The heated resistor vaporizes a tiny volume of ink to eject the ink through the nozzle.

One or more power supply inputs 32 provide various power levels to the firing elements 50 and 52. Three exemplary power supply inputs are those used to provide the power for the firing logic, including the Vpp source (e.g. 0 to 12 Volts), a V12 source (e.g., 12 Volts), and a Vdd source (e.g., 5 Volts). These power supply inputs may occasionally and unpredictably fluctuate outside of normal operating conditions to levels that may damage or destroy certain ones of the firing elements 50 and 52. For instance, an aberration in the power level running the firing logic may cause destructive overheating in the firing resistors 50. In addition, an absence of power to the firing logic may result in unpredictable firings.

To prevent such damage resulting from power supply faults, the IC chip 44 also has power supply fault protection circuitry 42 integrated with the firing elements 50 and 52. The power supply fault protection circuitry 42 includes a power supply fault detector 60 coupled to receive one or more power supply inputs 32. The power supply fault detector 60 detects whether any of the power supply inputs 32 are experiencing a fault condition. Examples of a fault condition include absence of power or a power level that is not appropriate for operation. When a fault condition is detected, the power supply fault detector 60 outputs a "kill" signal to kill or disable the firing elements 50 and 52.

One aspect of the chip design is that the power supply fault detector 60 is energized by power source Vpp, the same source used to heat the firing resistors 50. If Vpp is not present to energize the fault detector 60, it is likewise absent from the resistors 50 and cannot damage the resistors, thereby obviating the need for protection.

The protection circuitry 42 also has protection transistors 62(1)–62(N) for corresponding pairs of firing resistors 50(1)–50(N) and firing transistors 52(1)–52(N). Each protection transistor 62 has a gate coupled to receive the "kill" signal from fault detector 60 and a drain-to-source path coupled between the gate of an associated firing transistor 50 and ground GND. In normal operation, the "kill" signal is low, turning off the protection transistors 62 and allowing the firing signals to operate as normal, turning on and off associated firing transistors 52.

Figure 4:
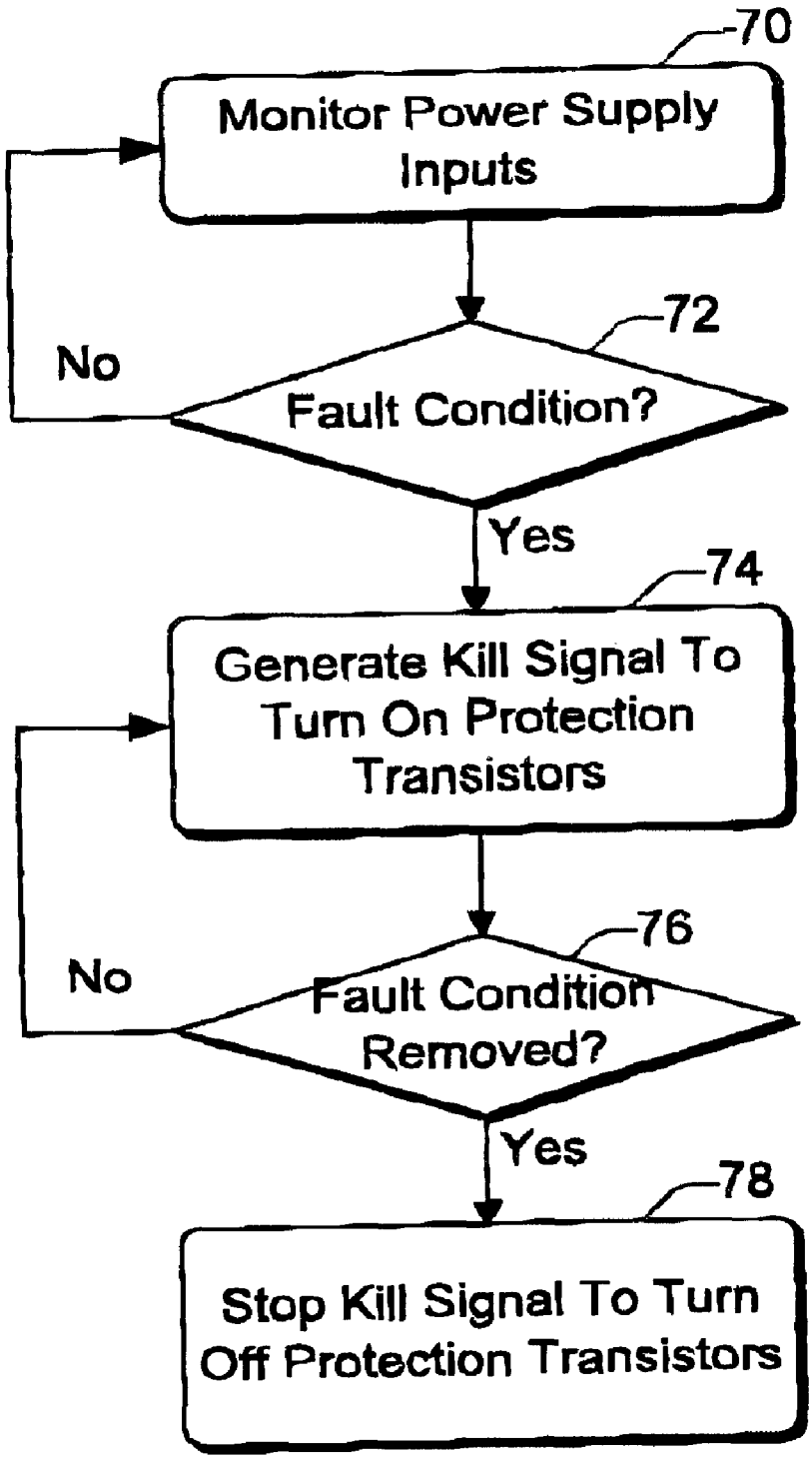
FIG. 4 is a flow diagram of a method for protecting against power supply faults.

FIG. 4 shows a method for protecting elements on the IC chip 42, and namely the firing transistors 50, from destructive overheating as a result of power fluctuations. The method is described with additional reference to FIG. 3. At steps 70 and 72, the power supply fault detector 60 monitors the power supply inputs 32 for any aberration in one of the power supply inputs. When a default condition is detected (i.e., the "yes" branch from step 72), the fault detector 60 asserts the kill signal to turn on all of the protection resistors 62(1)–62(N) (step 74). When turned on, the protection resistors 62 discharge all gates of the firing transistors 52, thereby overriding any firing signals to these transistors. With the gates of the firing resistors 52 tied to ground, all firing of the nozzles ceases.

At step 76, the power supply fault detector 60 determines whether all power supplies return to a proper operating level. The "kill" signal remains high until all power supplies return to a proper level. When the fault condition is finally removed (i.e., the "yes" branch from step 76), the fault detector 60 returns the "kill" signal to low, thereby turning off the protection resistors 62(1)–62(N) (step 78).

Figure 5:
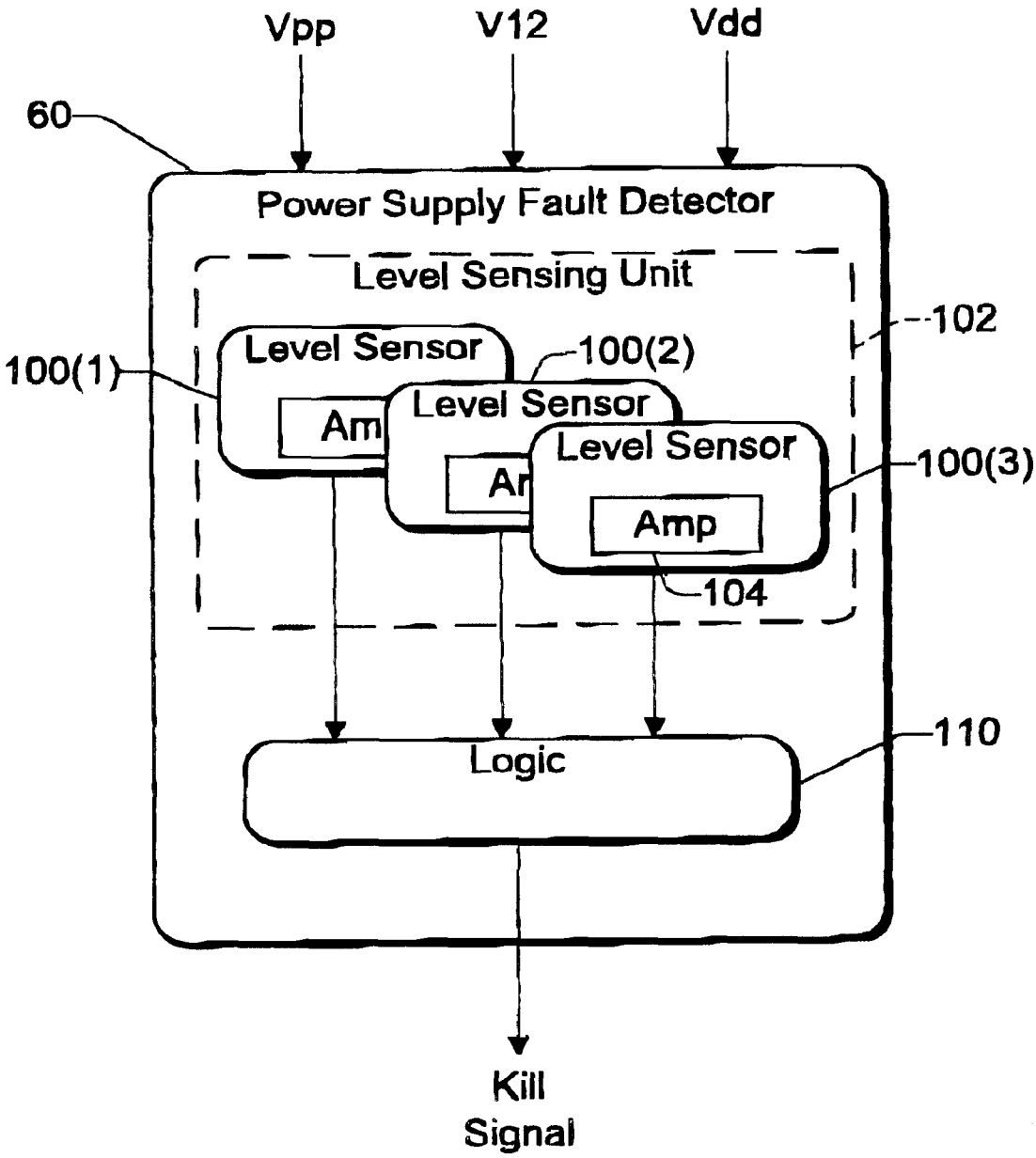
FIG. 5 is a schematic of a power supply fault detector that forms part of the power supply fault protection circuitry.

FIG. 5 shows the power supply fault detector 60 according to one exemplary implementation. It includes at least one voltage level sensor for sensing the voltage level of the power supply inputs. In this example, there are three level sensors 100(1), 100(2), and 100(3) for each of the three power supply inputs Vpp, V12, and Vdd. It is noted that the three level sensors may be alternatively implemented as an integrated unit, as illustrated by level sensing unit 102. When any one of the level sensors 100 (or the unit 102) senses a fault condition in a power input (e.g., no power or inappropriate level), the level sensor outputs a signal indicating a fault condition. Each level sensor 100 (or the level sensing unit 102) may also have an amplifier 104 to bring the fault condition signal to logic levels (e.g., 5 volts).

The power supply fault detector 60 also has logic 110 to receive the fault condition signals from the level sensors 100(1)–100(3). The logic is configured, for example, to apply an OR operation to the fault condition signals. In this manner, the logic 110 outputs the "kill" signal anytime any level sensor 100(1)–100(3) generates a fault condition signal.

The power supply fault protection circuitry described herein is advantageous because it guards against harmful and destructive effects on firing resistors resulting from power supply fluctuations. Since the power supply fault protection circuitry is integrated into a pen-based chip that also forms the firing elements (and optionally the firing logic), the circuitry offers a low cost solution to problems associated with power supply fluctuations.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A printing device comprising:

a print head having multiple nozzles and multiple firing elements for corresponding nozzles;

control circuitry to supply data and at least one power source to the print head, the power source being supplied to the firing elements; and power supply fault protection circuitry resident at the print head to detect a fault condition in the power source and to disable the firing elements in response to detecting the fault condition.

2. A printing device as recited in claim 1, wherein the power supply fault detection circuitry is integrated with the firing elements on an integrated circuit chip.

3. A printing device as recited in claim 1, wherein the power supply fault protection circuitry comprises:

a power supply fault detector to detect the fault condition and to output a signal when the fault condition is detected; and protection elements connected to associated firing elements, the protection elements further connected to receive the signal from the power supply fault detector and to disable the firing elements upon receipt of the signal.

4. A printing device as recited in claim 1, wherein:

the firing elements comprise a firing resistor and a firing transistor for each of the nozzles; and the power supply fault protection circuitry comprises a power supply fault detector connected to detect the fault condition and to output a signal when the fault condition is detected, the power supply fault protection circuit further comprising a protection transistor for each of the nozzles, the protection transistor being connected to an associated firing transistor and to the power supply fault detector to discharge the firing transistor in response to output of the signal.

5. A printing device as recited in claim 4, wherein:

the firing resistor is connected in series with a drain-to-source path of the firing transistor between power and ground; and the protection transistor has a gate connected to receive the signal from the power supply fault detector and a drain-to-source path connected between a gate of the firing transistor and the ground.

6. A printing device as recited in claim 4, wherein the power supply fault detector comprises at least one voltage level sensor to sense the level of the power source.

7. A printing device as recited in claim 4, wherein the firing resistor and the power supply fault detector are connected to a common power supply.

8. A printing device as recited in claim 1, embodied as an inkjet printer.

9. An inkjet print head comprising:

multiple nozzles;

multiple firing elements for corresponding nozzles, the firing elements being connected to receive power from at least one power source; and power supply fault protection circuitry to detect a fault condition in the power source and to disable the firing elements in response to detecting the fault condition, the power supply fault protection circuitry being resident within the print head.

10. An inkjet print head as recited in claim 9, wherein the power supply fault protection circuitry and the firing elements are integrated on an integrated circuit chip.

11. An inkjet print head as recited in claim 9, wherein the power supply fault protection circuitry comprises:

a power supply fault detector to detect the fault condition and to output a signal when the fault condition is detected; and protection elements connected to associated firing elements, the protection elements further connected to receive the signal from the power supply fault detector and to disable the firing elements upon receipt of the signal.

12. An inkjet print head as recited in claim 9, wherein:

the firing elements comprise a firing resistor and a firing transistor for each of the nozzles; and the power supply fault protection circuitry comprises a power supply fault detector connected to detect the fault condition and to output a signal when the fault condition is detected, the power supply fault protection circuit further comprising a protection transistor for each of the nozzles, the protection transistor being connected to an associated firing transistor and to the power supply fault detector to discharge the firing transistor in response to output of the signal.

13. An inkjet print head as recited in claim 12, wherein:

the firing resistor is connected in series with a drain-to-source path of the firing transistor between power and ground; and the protection transistor has a gate connected to receive the signal from the power supply fault detector and a drain-to-source path connected between a gate of the firing transistor and the ground.

14. An inkjet print head as recited in claim 12, wherein the power supply fault detector comprises at least one voltage level sensor to sense the level of the power source.

15. An inkjet print head as recited in claim 12, wherein the firing resistor and the power supply fault detector are connected to a common power supply.

16. A printer incorporating the inkjet print head of claim 9.

17. A method for protecting firing elements in an inkjet print head, comprising:

detecting a fault condition in a power source supplied to the firing elements in the inkjet print head, wherein said detecting is achieved by circuitry resident within the print head; and disabling the firing elements in response to detecting the fault condition.

18. A method as recited in claim 17, wherein the firing elements include firing transistors that, when turned on by firing pulses, fire an associated nozzle, and the disabling comprises discharging the firing transistors to override the firing pulses and prevent firing of the associated nozzles.

* * * * *